US006642906B1

(12) United States Patent
Machalek

(10) Patent No.: US 6,642,906 B1
(45) Date of Patent: Nov. 4, 2003

(54) SELF-RIGHTING ASSEMBLY

(75) Inventor: Milton D. Machalek, Conestoga, PA (US)

(73) Assignee: Star-H Corporation, Lancaster, PA (US)

( * ) Notice: Subject to any disclaimer, the term of this patent is extended or adjusted under 35 U.S.C. 154(b) by 0 days.

(21) Appl. No.: 10/174,107

(22) Filed: Jun. 14, 2002

(51) Int. Cl.[7] ..... H01Q 1/42
(52) U.S. Cl. ..... 343/872; 348/375
(58) Field of Search ..... 343/793, 842, 343/872, 894, 709, 719

(56) References Cited

U.S. PATENT DOCUMENTS

| | | | | |
|---|---|---|---|---|
| 3,611,277 A | * | 10/1971 | Yoder | 367/174 |
| 4,631,709 A | * | 12/1986 | Bender et al. | 367/4 |
| 5,394,661 A | | 3/1995 | Noble | 52/167.4 |
| 5,406,287 A | | 4/1995 | Pinkus | 342/13 |
| H1560 H | | 7/1996 | Gill et al. | 342/385 |
| 6,456,197 B1 | * | 9/2002 | Lauritsen et al. | 340/539.26 |
| 2003/0011706 A1 | * | 1/2003 | Chang et al. | 348/375 |

* cited by examiner

*Primary Examiner*—Don Wong
*Assistant Examiner*—Shih-Chao Chen
(74) *Attorney, Agent, or Firm*—Martin Fruitman

(57) ABSTRACT

The invention is a self-righting assembly which always comes to rest in a prescribed orientation relative to gravity regardless of the orientation of the assembly within which the self-righting assembly is mounted. It is particularly useful for systems such as radio frequency antennas which must be oriented in a particular manner for transmission. The structure comprises two concentric spheres transparent to the radiation generated, separated by a dielectric fluid which nearly fills the space between the spheres and suspends the inner sphere. The antenna or radiator and its associated electronic circuitry are within the inner sphere which is weighted to always rest in a prescribed orientation relative to gravity. The assembly can be dropped or thrown, and regardless of how it lands, the radiation source will always be capable of proper transmission.

11 Claims, 1 Drawing Sheet

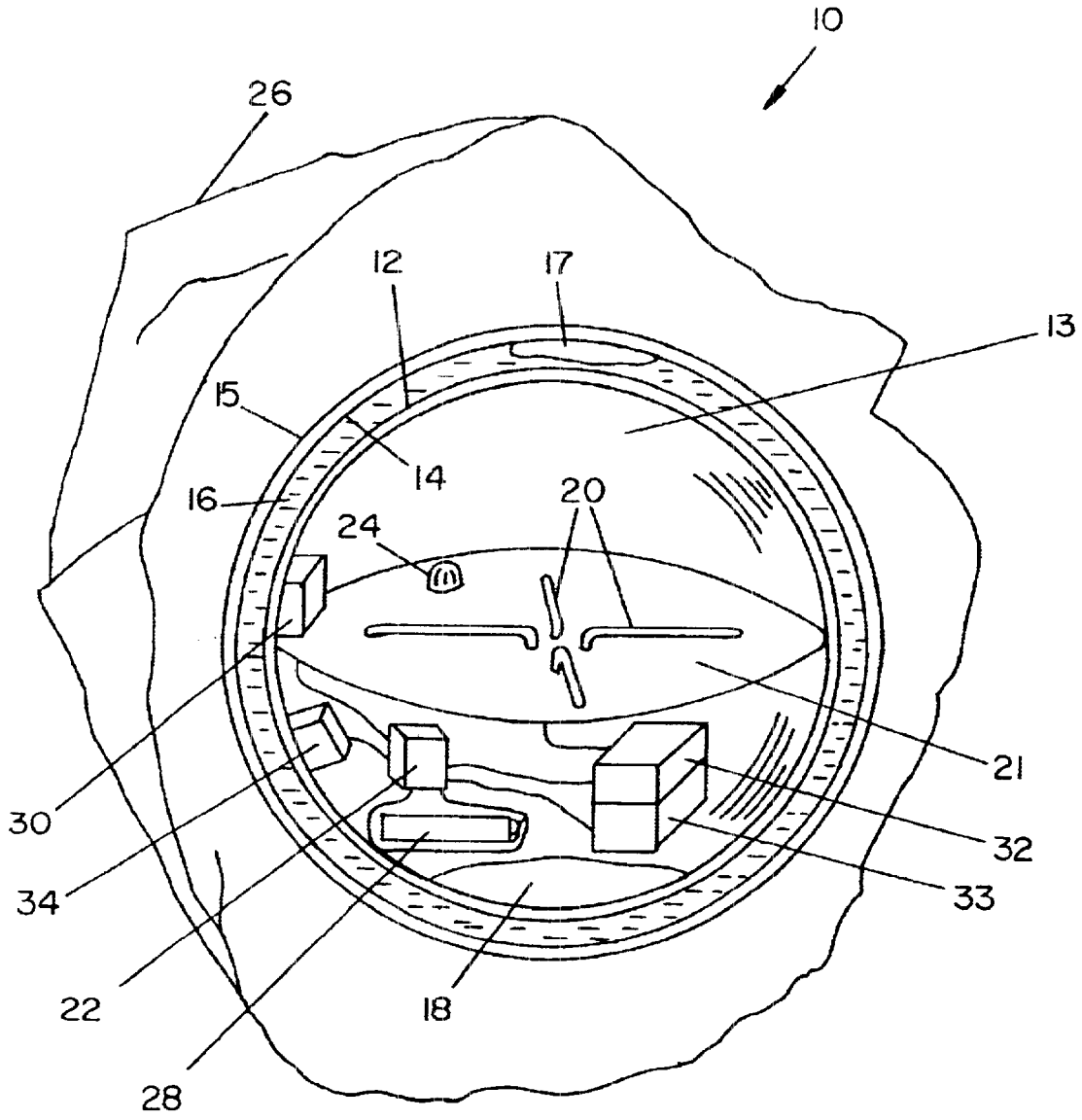
10
26
12
17
13
15
14
16
20
24
21
30
32
34
33
22
18
28

SELF-RIGHTING ASSEMBLY

BACKGROUND OF THE INVENTION

This patent deals generally with self righting devices and more specifically with an apparatus which can contain sensors and radiation generators such as radio transmitters or light sources and can always maintain the radiation in a preferred orientation relative to gravity regardless of the position of the outer container of the assembly.

Perhaps the most commonly known self-righting devices are the child's toy usually referred to as the "roly-poly" clown and the self-righting punching bag. The first is a small plastic toy with a heavily weighted round bottom and a top with a clown body. The second is very similar in construction but is usually inflated, about three feet tall, and made of soft vinyl. Both of these toys maintain their upright position, and return to it when tilted, because the weight in the rounded bottom always seeks the lowest position due to the force of gravity. In fact, sea buoys and boats use the same principle to maintain an upright position, but they are not on a solid surface. Even the round bottom toys depend to some extent upon a flat surface, so that they can not right themselves if, for example, they are forced into a corner or a rock is placed under them.

There is a need for such a self-righting motion with the use of modern. technology. Emergency radio transmitters, crash site locator beacons, intrusion detectors, global positioning systems, and military radiation decoys all receive or generate radiation signals, and all have a preferred orientation for their antennas or beams. Inventors have addressed this problem with at least two completely different techniques.

U.S. Pat. No. 5,406,287 to Pinkus discloses an air dropped infrared decoy that has a spherical casing with multiple infrared sources on its surface so that at least one emitter will always be aimed upward regardless of the position of the casing.

U.S. Statutory Invention Registration H1560 to Gill et al discloses a crash site locator radio beacon dropped by parachute that uses a weighted hemispherical bottom to vertically orient a rod antenna and strobe beacon. This design, as most weighted rounded bottom devices, requires a reasonably flat smooth surface to assure proper orientation.

However, in the real world, and except for the residential environment in which the children's toys are used, flat smooth surfaces are not usually available, so that, for instance, if the Gill device were to land in a gully or on a rock, there is little likelihood that the antenna and strobe beacon would be properly oriented.

It would be very beneficial to have available a structure which would assure the proper orientation of antennas, light sources, and other radiation sources regardless of the actual positioning of the overall structure.

SUMMARY OF THE INVENTION

The present invention is a self-righting assembly which always maintains itself in a prescribed orientation relative to gravity regardless of the orientation of the structure within which it is mounted. It is particularly useful for communication systems such as light sources and antennas of radio frequency transmitters that must be specifically oriented relative to gravity for proper transmission, and it can be installed in a larger structure of any irregular shape.

The structure comprises two containers that are transparent to the radiation of the included transmitter and which form two concentric spheres. The concentric spheres are actually the outer surface of an inner container which contains the active components of the assembly, and the inner surface of the outer container. The spheres are separated by a fluid within the space between the spheres.

Since there must be an accommodation to the possible thermal expansion of the fluid, the simplest method is to leave a small amount of space between the spheres unfilled by the liquid. It is also possible to completely fill the liquid space and include a device such as a bellows within either the inner or outer container to accept any increased liquid volume.

A more subtle requirement for the liquid is that its specific gravity must be such that the inner container has an approximate neutral buoyancy within it, that is, the inner container will neither sink nor rise within the fluid. This assures that the inner sphere does not touch the spherical inner surface of the outer container. This neutral buoyancy is easiest to accomplish by adjusting the weight of the contents of the inner container after an appropriate fluid is selected. The fluid must also be transparent to the transmitter's radiation, so that, for instance, for a radio transmitter it must be a dielectric fluid. An antenna or another energy radiator and sensors and associated electronic circuitry are all enclosed within the inner container, which is weighted to always rotate and rest in a prescribed orientation relative to gravity, with a its heaviest segment down.

It should be noted that, although the terms "inner sphere" and "outer sphere" are used throughout this specification, they refer to only the outer surface of the inner container and to inner surface of the outer container which are the only surfaces that actually need to be spherical to accommodate the rotation of the inner container. Although also shown as spherical surfaces for convenience and because such a configuration is easier to manufacture, the outside surface of the outer container and the inner volume of the inner container have no restriction on their shapes.

The assembly of the invention can therefore be dropped or thrown, and regardless of how it lands, the inner sphere will always take the same position because there is nothing to interfere with its rotation. The antenna or radiation source and also the internal sensors will always be oriented in the same position relative to gravity. Therefore, an upward directed antenna or radiation source will always be capable of vertical transmission. Furthermore, any included sensors will also be oriented as desired. For example, light detectors can always be oriented at an appropriate angle to the horizontal, and other sensors, such as vibration or magnetic sensors can be oriented horizontally if that is the desirable orientation in order to be most sensitive to ground activity.

The self-righting structure is particularly useful as a trespassing detector. For such applications the invention can be deployed in disguised form, for example, by being painted to blend in with its surroundings or by being encased in plastic artificial stone. To further reduce the probability of detection, a radio transmitter within a unit can be designed to transmit extremely short transmission bursts or to transmit only when an included sensor receives a signal. Furthermore, a global positioning system, and its receiving antenna can also be included in the assembly so that the unit can also transmit its own exact location.

The invention can thereby be used as a remote intrusion detector which is itself virtually undetectable.

BRIEF DESCRIPTION OF THE DRAWING

The FIGURE is a side view of the preferred embodiment of the invention.

DETAILED DESCRIPTION OF THE INVENTION

The FIGURE is a side view of the preferred embodiment of self righting assembly 10 in which inner sphere 12, the outer surface of inner container 13, is suspended within outer sphere 14, the curved internal wall of outer container 15, by the neutral buoyancy of inner container 13 within liquid 16. Inner container 13 includes weight 18, which along with liquid 16 and the conformity of inner sphere 12 to outer sphere 14 causes the rest position of inner sphere 12 to be the orientation shown in the FIGURE with weight 18 at the lowest location within outer sphere 14. Liquid 16 actually does not completely fill the space between the spheres, because a small volume 17 is left without liquid to account for thermal expansion of the liquid.

The predictable orientation of inner sphere 12 permits the components within inner container 13 to be always in a prescribed orientation relative to the force of gravity. Thus, radio frequency antenna elements 20 which can be used for both transmission and receiving and antenna ground plane 21 are always located above electronics module 22 and other components within inner container 13, and the antennas will always transmit and receive upward. Similarly, any other radiation device, such as lamp 24 can also be oriented to assure that it will always be visible from above.

Of course, to assure transmission of any radiation from inner container 13, the materials of outer container 15, inner sphere 12, and liquid 16, along with any outer covering material 26, must be transparent to the radiation being transmitted. In the case of radio frequency transmissions, that means that all the materials must be dielectric materials, that is electrical insulators. In the case of visible light, that means the materials must be transparent.

Typical components within electronics module 22 are battery 28, sensor 30, radio frequency transmitter 32 and radio frequency receiver 33, and virtually any circuit can be placed within control module 22. For instance, sensor 30 can be an optical detector monitoring a near horizontal plane, which, when it senses non-ambient light, causes control module 22 to turn on transmitter 32 to transmit a signal indicating nearby activity. Furthermore, radio frequency receiver 33 can be a Global Positioning System receiver or a receiver receiving control signals for the self-righting assembly itself.

A particular benefit of self righting assembly 10 is the ease with which it can be disguised and hidden, particularly when its major function does not include generating a light beam. When outer covering material 26 is constructed of a plastic which visually appears to be stone and completely encloses outer sphere 14, and as long as the material is transparent to radio frequencies, entire self righting assembly 10 is virtually undetectable. Such an assembly can be distributed over any landscape and transmit information from sensors such as vibration or magnetic detectors, or if the outer covering material is properly selected, from an optical sensor.

Because self-righting assembly 10 is completely sealed, switch 34 is required for initially activating the unit when it is put into service. Such a switch can easily be designed to be an accelerometer activated by a directional physical shock or a radio frequency circuit activated. by a radio frequency transmission. With either starting device the circuitry would simply be designed to remain activated once started.

The primary factor in determining the physical size of the assembly is the wavelength of the radio frequency to be transmitted or received which determines the size of the antenna. For most frequencies of interest the assembly would likely be the size of a baseball, about three inches in diameter.

The preferred embodiment of self-righting assembly 10 has transmitter 32 operating at 2.5 Ghz and has:

- outer sphere 14 with 2.75 inches inner diameter and constructed of 1/16inch thick polyethylene;
- inner sphere 12 with 2.375 inches outer diameter and constructed of 1/16inch thick polyethylene;
- 0.125 inch thick layer of liquid 16 which is soybean oil;
- antenna 20 with elements 1.0 inch long;
- ground plane 21 located approximately 1.25 inch from the lower inside surface of inner sphere 12; and
- container 13 weighing approximately 100 grams.

Self righting assembly 10 with inner container 13 enclosing antennas, transmitters, sensors, other electronics, and offset weight 18, and suspended in liquid 16 within outer sphere 14, assures that inner container 13 will always orient itself with the antennas upward. This upward orientation of the antennas provides optimum radio frequency transmission to either airborne stations or satellites, or with other appropriately designed antennas, to ground based stations.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, antennas of various configurations, such as loop or dipole antennas, and antennas with or without ground planes, can be used, and sensors can be oriented for detection in any angle to the vertical. Moreover, although it is generally more convenient to make both the inside and outside surfaces of both containers spherical, the only basic requirement is that the internal volume of the outer container and the outer surface of the inner container be spherical.

What is claimed as new and for which Letters patent of the United States are desired to be secured is:

1. A self-righting assembly comprising:

a sealed outer container with curved walls forming an internal spherical volume;

a sealed inner container with an inner volume and a spherical outside surface with a center of the spherical outside surface located within the inner volume, the inner container located within the internal spherical volume of the outer container with a space between the spherical outside surface of the inner container and the curved walls of the outer container;

a liquid within the space between the spherical outside surface of the inner container and the curved walls of the internal spherical volume of the outer container, the liquid having a specific gravity sufficient to suspend the inner container within the internal spherical volume of the outer container; and a weight included in the inner container and offset from the center of the spherical outside surface of the inner container so that the inner container turns within the internal spherical volume of the outer container to rest with the weight located at the lowest point of the internal spherical volume of the outer container.

2. The self-righting assembly of claim 1 further including an antenna within the inner container with the antenna located to transmit at a preselected angle to the vertical when the inner container is at rest.

3. The self-righting assembly of claim 1 further including a transmitter and a transmitting antenna with which the transmitter is interconnected.

4. The self-righting assembly of claim 1 further including a sensor and a transmitter with which the sensor is interconnected.

5. The self-righting assembly of claim 4 wherein the sensor is a light sensor.

6. The self-righting assembly of claim 4 wherein the sensor is a vibration sensor.

7. The self-righting assembly of claim 4 wherein the sensor is a magnetic sensor.

8. The self-righting assembly of claim 1 further including a turn on switch which can be activated by a means external to the self righting assembly.

9. The self-righting assembly of claim 1 further including a receiver and an antenna with which the receiver is interconnected.

10. The self-righting assembly of claim 1 further including a Global Positioning System receiver and an antenna with which the Global Positioning System receiver is interconnected.

11. The self-righting assembly of claim 1 further including an antenna within the inner container with the antenna located above the other components within the inner container when the inner container is at rest.

* * * * *